United States Patent [19]

Oram

[11] Patent Number: 4,564,892

[45] Date of Patent: Jan. 14, 1986

[54] APPARATUS FOR PRODUCING TWO MUTUALLY DIVERGENT LIGHT BEAMS

[75] Inventor: John A. Oram, Leighton Buzzard, England

[73] Assignee: J & D Oram Limited, Leighton Buzzard, England

[21] Appl. No.: 638,457

[22] PCT Filed: Dec. 1, 1983

[86] PCT No.: PCT/GB83/00313

§ 371 Date: Jul. 31, 1984

§ 102(e) Date: Jul. 31, 1984

[87] PCT Pub. No.: WO84/02173

PCT Pub. Date: Jun. 7, 1984

[30] Foreign Application Priority Data

Dec. 1, 1982 [GB] United Kingdom ..... 8234301

[51] Int. Cl.[4] ..... F21V 7/02

[52] U.S. Cl. ..... 362/297; 362/346; 362/347

[58] Field of Search ..... 362/297, 341, 346, 347, 362/804

[56] References Cited

U.S. PATENT DOCUMENTS

| | | | |
|---|---|---|---|
| 4,409,646 | 10/1983 | Baliozian | 362/346 X |
| 4,441,141 | 4/1984 | Lo | 362/346 X |

FOREIGN PATENT DOCUMENTS

| | | |
|---|---|---|
| 570288 | 1/1933 | Fed. Rep. of Germany . |
| 1013241 | 8/1957 | Fed. Rep. of Germany . |
| 1187207 | 2/1965 | Fed. Rep. of Germany . |
| 751001 | 8/1933 | France . |
| 279875 | 3/1928 | United Kingdom . |
| 534455 | 3/1941 | United Kingdom . |
| 648271 | 1/1951 | United Kingdom . |
| 1372024 | 10/1974 | United Kingdom . |

*Primary Examiner*—Tony M. Argenbright

*Attorney, Agent, or Firm*—Sughrue, Mion, Zinn, Macpeak and Seas

[57] ABSTRACT

Two concave reflector portions (22*a*, 22*b*) confront each other and have narrow ends (14) which overlap. The reflector portions widen from respective beam-emission axes (13) to their wide ends (16). The beam-emission axes are oppositely-directed. The apparatus has beam-emitting apertures (18) at the wide ends. A bulb (24) disposed between the overlapping narrow ends of the reflector portions produces two mutually divergent light beams, by reflection off the reflector portions.

15 Claims, 11 Drawing Figures

APPARATUS FOR PRODUCING TWO MUTUALLY DIVERGENT LIGHT BEAMS

Figure 1:
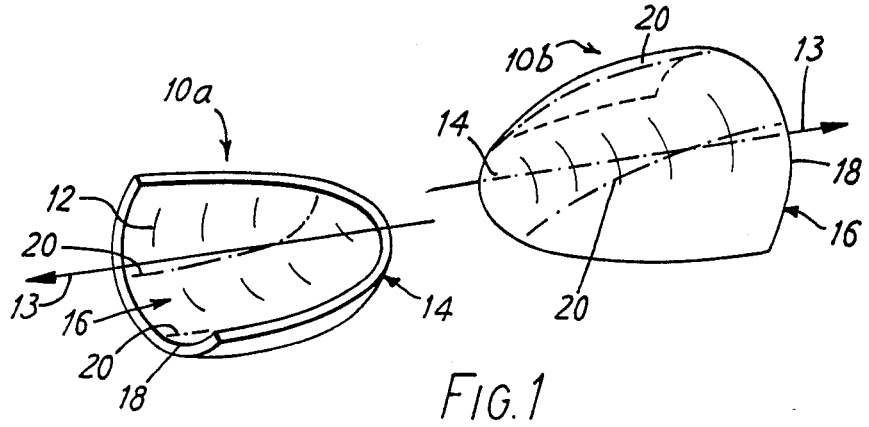

The present invention relates to apparatus for producing two mutually divergent light beams from a single light source. Such apparatus is useful in dental and other medical lamps where the two beams are redirected to a common illumination area by mirrors in the paths of the two beams, so as to achieve the effect of illumination from spaced light sources, for the purpose of producing relatively shadow-free illumination.

Apparatus has been proposed for producing two oppositely-directed light beams in which light from a source is collected by a concave reflector to produce a convergant beam. The beam is incident on a pair of mirrors oriented at about 45° to the beam axis and on respective sides of the axis. The two mirrors split the beam into a pair of beams which are oppositely-directed and are perpendicular to the first beam. In a lamp unit incorporating the known apparatus, each beam is re-reflected and focused so that the two beams combine at a plane to form a single patch of light. The illumination provided at the plane is substantially shadow-free, because the two beams arrive at the plane from different directions. Thus, in many situations when an object blocks a first of the beams, the shadow of the first beam is illuminated by the second beam. By using light stops in the path of each beam to limit the width of the beam; and by arranging that the image of the stops is at the plane of the patch, the apparatus provides a patch of light which cuts off abruptly.

The object of the present invention is to provide an improved apparatus which is more compact and requires fewer reflections, and thereby reduces the light losses which are inevitable at each reflection.

The present invention provides apparatus for producing two mutually divergent light beams from a single light source, comprising two concave reflector portions each of which widens away from a respective beam-emission axis from a first end to a second end, at which second end is the beam-emitting aperture of the reflector portion, the two reflector portions confronting and overlapping each other at their first ends and having their beam-emission axes mutually divergent, whereby a light source disposed between the overlapping regions of the reflector portions produces the two mutually divergent beams.

The two reflector portions may be strips with simple curvature such as to produce the widening away from the beam-emission axes. However, it is preferred to employ sectorial portions having compound curvature. For example, the two portions may be halves of a complete concave reflector such as a parabolic or ellipsoidal reflector. Alternatively the two portions may be cut down (notionally) from such halves. Such notional cutting down is not restricted to reducing the angle subtended at the beam-emission axis. For example, any part of a half reflector which makes little useful contribution to the emergent beam can be cut away without adverse effect and the perimeter of the sectorial portion may be of largely arbitrary shape. Those parts of the reflector surfaces which reflect light which is subsequently interrupted by a stop may therefore be cut away. Parts of the reflector portions may also be cut away specifically to allow introduction of the light source.

Apparatus according to the invention produces two mutually divergent light beams without using mirrors additional to the concave reflectors and by using reflectors which may be smaller than the reflector used in the known apparatus described above. Smaller reflectors may be more easily made. Since each reflector is only a sector, it can be made by pressing in a mould. Small reflectors are cheaper to produce by pressing than by the process used for making large reflectors of sagging a heated glass plate into a concave pattern. Small reflectors may be more accurately coated since the coating is applied on to a relatively open sector instead of into a deep, cup-like reflector. The optical path of the present apparatus is more compact than that of the known apparatus because the limb of the path of the known apparatus from the concave reflector to the beam-splitting mirrors is eliminated.

Throughout this specification the terms "aperture" and "beam-emission axis" are used in the following senses. "Aperture" is used in the sense which is well-known in the art of optics, to mean the area through which light passes in optical apparatus and more specifically the area through which an emergent light beam leaves a reflector. The term does not necessarily imply a hole in an integer of the apparatus through which light may pass. The term "beam-emission axis" denotes the line which would coincide with the central ray of the beam produced when the notional uncut reflector is illuminated by a light source positioned at its focal point. In the case of a reflector whose reflective surface is a surface of revolution, the beam-emission axis is the axis of revolution. The beam-emission axis does not necessarily coincide with the central ray produced when a reflector portion is illuminated.

The mutually divergent beams may be oppositely directed, i.e. in directions approximately 180° apart, but other mutually divergent directions are possible.

Figure 2:
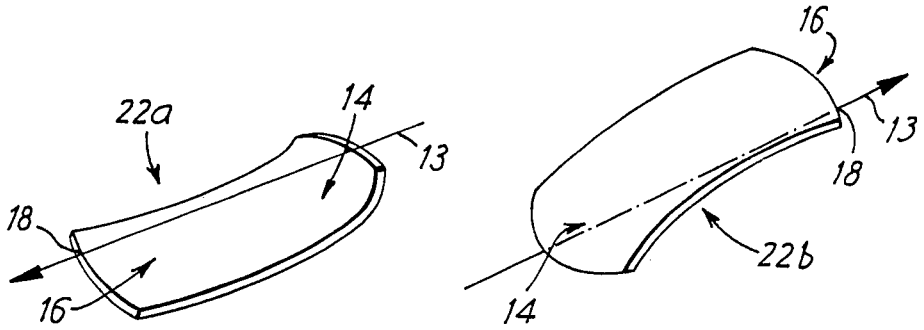
Figure 3:
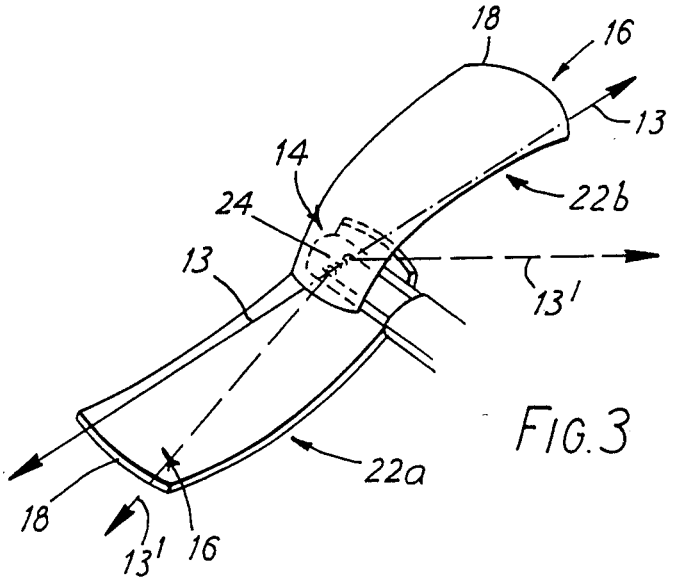
Figure 4:
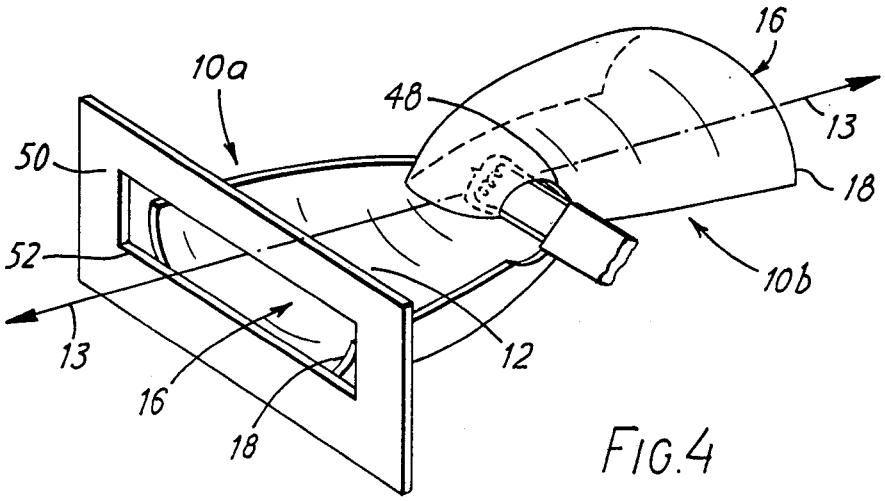
Figure 6:
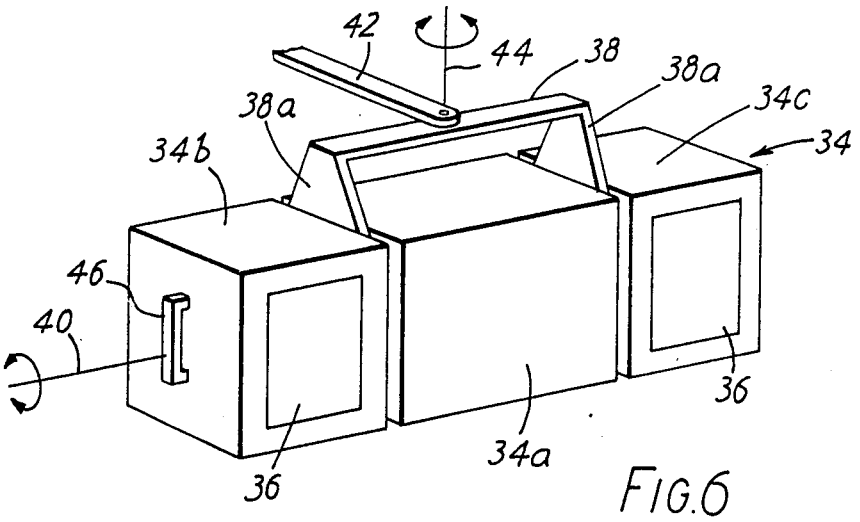
Figure 7:
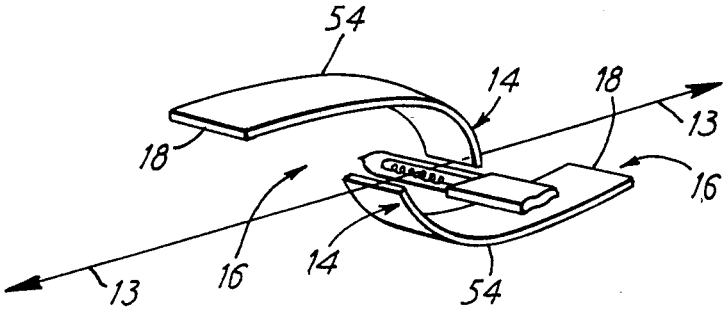
Figure 5:
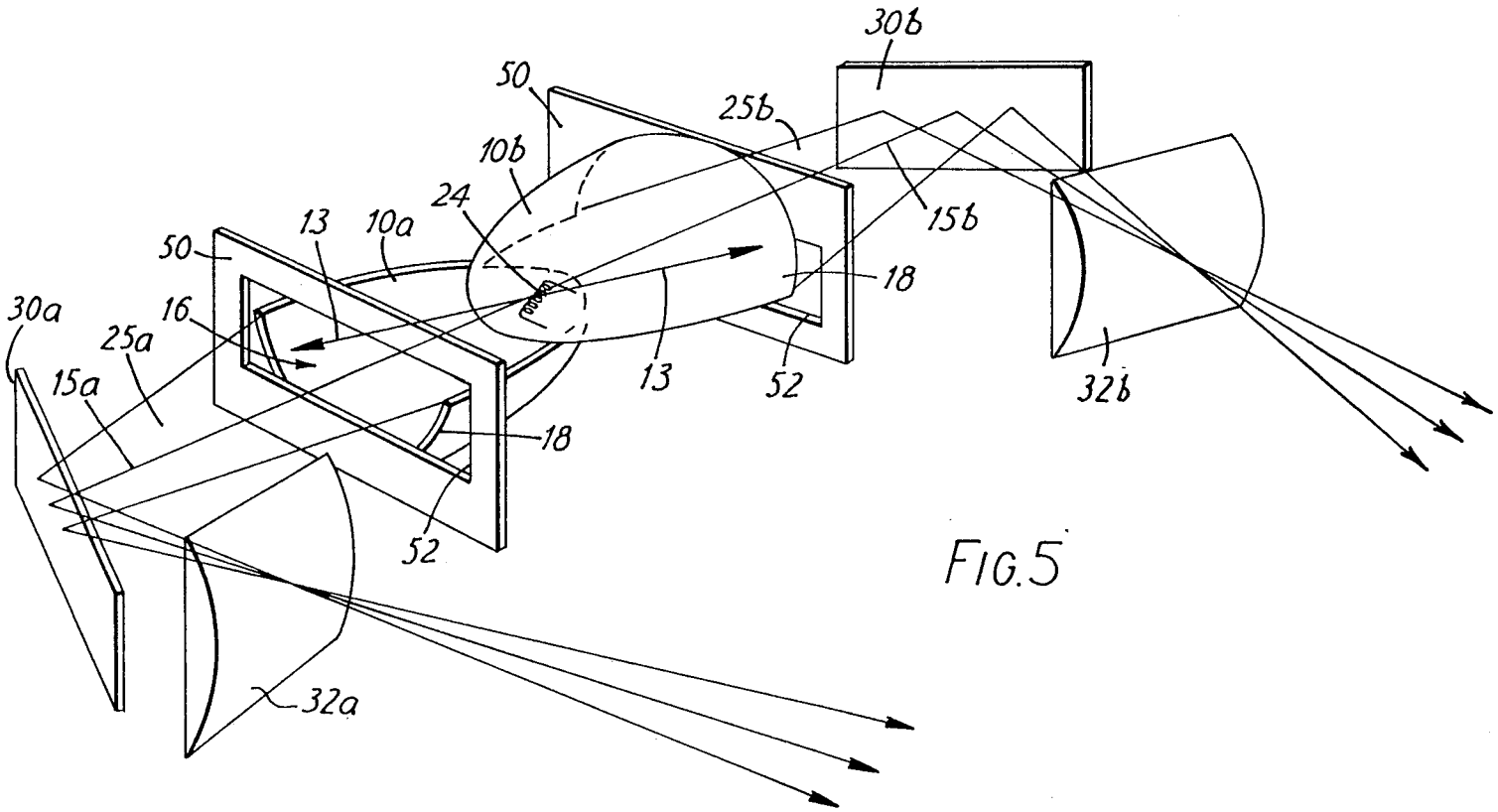
Figure 8:
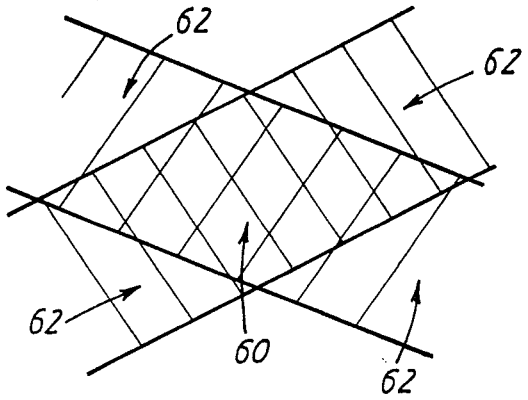

Embodiments of the invention will now be described by way of example, with reference to the accompanying drawings in which:

FIG. 1 is a perspective view showing the basic form of two reflector portions for use in a first embodiment, FIG. 2 is a perspective view of two reflector portions produced by cutting down the reflector portion of FIG. 1, and which may be used as an alternative to those of FIG. 1, FIG. 3 is a perspective view of the reflector portions of FIG. 2 disposed about a bulb, in apparatus embodying the invention, FIG. 4 is a perspective view of the preferred embodiment of the reflector portions, FIG. 5 is a schematic diagram of a lamp unit which incorporates apparatus according to the invention and which combines the two beams, FIG. 6 is a perspective view of the lamp unit of FIGS. 4 and 5, housed in a housing, FIG. 7 is a perspective view of an alternative embodiment of the reflector portions, FIG. 8 shows schematically the light patch produced by the apparatus of FIG. 5.

Figure 9A:
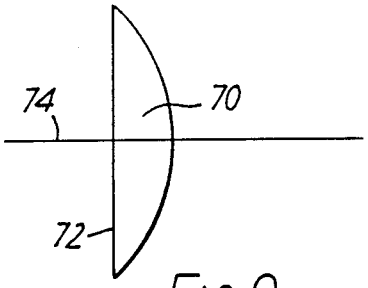
Figure 9B:
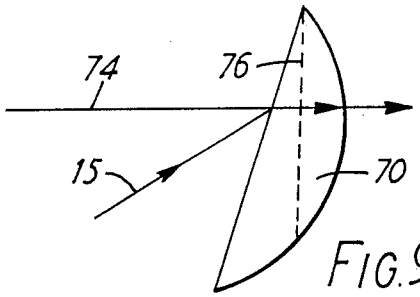
Figure 10:
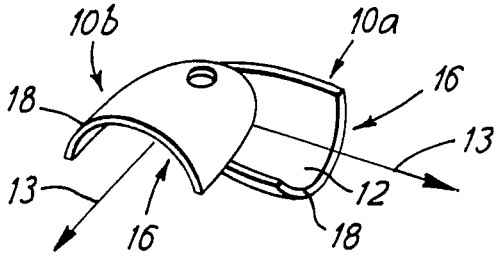

FIGS. 9*a* and 9*b* show an optical element for use in a modified version of the apparatus of FIG. 5, and FIG. 10 is a perspective view of an alternative arrangement of the reflector portions of FIG. 1.

FIG. 1 shows two sectorial portions 10*a*, 10*b* of a concave reflector having inside reflective surfaces 12 which are each half of an ellipsoidal surface of revolution which has been cut (notionally) in a plane termed hereafter the notional cutting plane. Each half 10*a*, 10*b* widens away from a respective beam-emission axis 13 from a narrow end 14 to a wide end 16. The semi-circular wide ends 18 of the reflector portions 10*a*,10*b* partially define the beam-emitting apertures 16 of the reflector portions 10*a*,10*b*. In FIG. 1 the two reflector portions 10*a*,10*b* are shown oriented so that the beam-emitting axes 13 are oppositely-directed. For clarity the reflector portions in FIG. 1 and also FIG. 2 are shown non-overlapping. The actual relative positions in embodiments of the invention are shown in subsequent Figures.

Four chain-dotted lines 20 indicate where the portions 10*a*,10*b* may be cut to reduce them to the sectorial reflector portions 22*a*,22*b* shown in FIG. 2.

Referring to FIG. 2, the sectorial reflector portions 22*a*,22*b* widen away from respective beam-emission axes 13, from a narrow end 14 to a wide end 18. The circularly arcuate wide ends 18 of the sectorial reflector portions 22*a*,22*b* partially define the beam-emitting apertures 16 of the reflector portions 22*a*,22*b*, which apertures are of a barrelled rectangular shape. The beam-emission axes 13 are also shown oppositely-directed in FIG. 2.

The reflector portions 22*a*,22*b* of FIG. 2 are shown in FIG. 3 disposed about a bulb 24 in apparatus embodying the invention. The near focal points of the two reflector portions 22*a*,22*b* are coincident, and the respective beam-emission axes 13 are in line. The two reflector portions 22*a*,22*b* confront each other and overlap each other at their narrow ends 14. The bulb 24 is disposed between the narrow ends 14 of the portions. When the light bulb 24 is energised, the reflector portions 22*a*,22*b* each reflect a part of the light output of the bulb 24 and thus two oppositely-directed light beams are produced, which leave the beam-emitting apertures 16 of the sectorial reflector portions. The beam-emitting apertures 16 are partially defined by the circularly arcuate wide ends 18 and are further partially defined by the overlapping narrow ends 14 and by the shape of the peripheries of the reflector portions between their ends.

Alternatively, the reflector portions of FIG. 1 could be cut down by cutting each portion once, in a plane parallel to the notional cutting plane. The part of each reflector portion used, is the strip between the notional cutting plane and the parallel plane in which the reflector portion is cut.

FIG. 4 shows the preferred embodiment of the invention. The reflector portions 10*a*,10*b* are shaped as in FIG. 1 and have reflective surfaces 12 which are complete halves of an ellipsoidal surface of revolution apart from cut-outs 48 in the narrow end 14 of each reflector portion 10*a*,10*b* which allow a light bulb 24 to be positioned between the opposed narrow ends 14 of the reflector portions. The beam-emitting apertures 16 of the apparatus are blocked by stops 50. The stops each comprise an opaque plate having a rectangular hole 52 through which light may pass. Only one stop is shown in FIG. 4, for the reflector portion 10*a*. The apparatus uses a linear filament in a plane perpendicular to the notional cutting plane and which contains the beam-emission axis. The mid-point of the filament is at the common focal point of the reflector portions. The filament is at an angle of about 45° with respect to the beam-emission axes. The filament shown in FIG. 4 has a coiled portion whose length is several times its diameter, although satisfactory results have been obtained using a filament in which these dimensions are equal. One filament which has been used has a coiled portion with a length and a diameter of 2.5 mm. When using a filament of these dimensions, variations in the angle of the filament with respect to the beam emission axes are still found to have a significant effect on the light distribution in the emitted beams.

Referring to FIG. 5, a lamp unit is shown diagramatically in which two oppositely-directed beams produced by apparatus embodying the invention, preferably the apparatus of FIG. 4, are combined to form a single patch of light. Two light beams 25*a*,25*b* are produced by reflection off the reflector portions 10*a*,10*b* of the output of the light source 24. The light source is shown diagramatically as a filament in FIG. 4.

The beams 25*a*,25*b* are convergant. A real light source cannot be confined to the common focal point of the reflector portions and, therefore, the resultant beams are not confined to the apertures defined by the semi-circular wide ends 18 of the reflector portions 10*a*,10*b* and the notional cutting plane. Stops 50 are provided at the wide ends 18 of the reflector portions and have rectangular holes 52, which block extraneous light.

Two plane mirrors 30*a*,30*b* reflect the oppositely-directed beams 25*a*,25*b* respectively into respective lens systems 32*a*,32*b* which are shown as single lenses in FIG. 4, although compound lenses may be employed. When the lamp unit is to be used as a dental lamp, or for any other purpose for which a cold light is required, the mirrors may be so coated as to transmit or absorb, rather than reflect, light of infra-red wavelengths, thereby removing the heat from the reflected beam.

FIG. 5 shows the points of convergance of the reflected beams to be at the entrance aperture of the lens systems. In practice the beams do not converge to a point. Instead, a distorted image of the filament is formed at the entrance aperture. The lens systems focus an image of the holes 52 in the stops 50 at an image plane which is also the plane at which the beams are combined. Thus, a single patch of substantially shadow-free illumination is provided, which cuts off sharply.

Preferably, the holes 52 in the stops 50 are dimensioned so that only the sides parallel to the notional cutting plane obstruct the beam, as shown in FIG. 5. With this arrangement, the resultant image of each beam at the image plane is a rectangular patch with a sharp cut-off only along its long sides. The intensity reduces more gradually at the ends of the patch. This allows the lamp unit to be used satisfactorily to illuminate objects nearer to and further from the unit than the image plane. In a plane out of and parallel to the image plane, the sharply defined edges of the two images are still coincident, but the ends of the images are spaced by a distance dependent on the distance of the plane from the image plane. If the ends of each image were sharply defined, the resultant light patch would have a central, well-defined and bright region and two well-defined peripheral regions illuminated by one beam only. Such a sharp change of illumination intensity with the patch is undesirable. In the arrangement shown, the light patch also has a central region illuminated by both beams, and two peripheral regions illuminated by one beam only, but, because the ends of the images are not sharply defined, the boundaries between these regions are not sharp and the overall light distribution is found to be more acceptable. When using the arrangement shown, it becomes less important to ensure that the object to be illuminated is precisely at the image plane of the lamp unit.

Since the edges of the holes 52 perpendicular to the notional cutting plane are not used to obstruct light, the stops 50 can each be replaced by a pair of opaque strips positioned above and below the notional cutting plane and with their lower and upper edges, respectively, parallel to that plane.

Preferably, the lens systems comprise only single, simple cylindrical lenses, as shown in FIG. 5, which have plane faces towards their respective plane mirrors 30 and cylindrical faces with axes which, after reflection in the mirrors, are at their respective stops 50, and parallel to the notional cutting plane. The design of the lens systems 32 depends on the desired light distribution at the common illumination area. The lens system may comprise a single lens or a combination of lenses. In addition, the mirrors 30*a*,30*b* may be curved to provide a focusing effect on the beam before it reaches the lens systems. Alternatively the focusing effect may be provided by curved mirrors alone.

If, as is preferred, the apparatus for producing the two beams is the apparatus shown in FIG. 4, having the filament orientation of that figure, the beam-emission axis 13 does not coincide with the central ray 15 of the beam. The holes 52 in the stops 50, the plane mirrors 30 and the lens systems 32 are all centred on the central rays 15*a*,15*b* rather than the beam-emission axes 13. An approximately rectangular patch of light is produced with a central region which is more brightly illuminated than the peripheral regions. The inclined filament ensures that the light emitted therefrom is efficiently collected by the two reflector portions.

The patch of light produced by this arrangement is shown schematically in FIG. 8. Each beam produces a substantially rectangular patch (the image of the respective hole 52). The patches overlap to provide a large central region 60 illuminated by both beams, but the images of the two holes 52 are rotated one with respect to the other (as shown in an exaggerated degree in FIG. 8) so that a significant amount of light is wasted illuminating peripheral areas 62 by one beam only. The problem arises from the fact that the central rays of the beams leaving the reflector portions lie one above and one below the notational cutting plane.

This problem can be overcome, crudely, by rotating the stops 50 to a position in which their images on the common illumination plane are coincident. However, because the narrow end of each reflector portion 10*a*, 10*b* acts as an out of focus stop in the beam generated by the other reflector portion, it is found that this solution is not entirely satisfactory.

An alternative modification of the apparatus of FIG. 5 has been found to overcome the problem in a better way. The mirrors 30*a*, 30*b* are arranged to be perpendicular to the notional cutting plane, so that the point of convergence of the beams lies in that plane. At the point of convergence the incident central ray of each beam is crossing the notional cutting plane. In the modified apparatus, a prism is positioned at or near the point of convergence of each beam, to redirect the central ray of the beam. The prisms transmit the central rays in the plane of the notional cut. The light patches of the resultant beams are then substantially coincident at the common illumination plane. Preferably the redirection of the central rays takes place before the beams enter the lens systems.

The central rays of the beams produced by the lamp units are not the rays with the greatest intensity. At the wide ends of the reflector portions, the beam intensity decreases away from the beam-emission axis, and hence, in the image plane, the illumination intensity of each image decreases across its width. However, because one reflector portion is above the notional cutting plane and one is below, it is opposite edges of the two images respectively which are brightest in the image plane. That is, the bright edge of one image is coincidental with the dim edge of the other when the images have been brought into coincidence. The resultant composite patch of light is found to have an illumination intensity which is greatest at the centre of the patch.

FIGS. 9*a* and 9*b* shows how a cylindrical lens can be used in the apparatus as a cylindrical lens with an integral prism. FIG. 9*a* shows a cylindrical lens 70 with its plane face 72 perpendicular to the notional cutting plane 74. The axis of its cylindrical face is in the notional cutting plane so that a ray in that plane passes undeviated through the lens.

FIG. 9*b* shows the same lens after it has been rotated about the axis of its cylindrical face, so that its plane face 72 is no longer perpendicular to the notional cutting plane 74. Consideration of an imaginary plane 76 through the lens, perpendicular to the notional cutting plane, shows that the lens now acts as a cylindrical lens oriented as in FIG. 9*a*, with an integral triangular prism contiguous with its plane face. The prism angle can be changed by rotation of the lens 70 about the axis of its cylindrical face. The prism angle is chosen so that the central ray 15 of the incident beam is redirected and transmitted in the notional cutting plane.

It will be seen that the plane mirrors in the apparatus of FIG. 5 may be rotated about the line of the central ray 15 to any angle without the principle of operation of the apparatus being affected. However, such rotation causes changes in the light intensity distribution across the resultant light patch. The distribution produced also depends on the shape of the reflector portions and the shape and orientation of the light source. These are all factors which may be varied within the scope of the invention. For example, linear filaments which are respectively aligned with the axes 13 and in a direction which is perpendicular to those axes and perpendicular to the notional cutting plane between the two reflector portions may be used. Such orientations may be achieved using a bulb with a transverse filament, i.e. transverse to the axis of the bulb itself, at different orientations of the bulb about its own axis. Moreover, filament orientations intermediate to these may be used. Another possibility is to use a filament perpendicular to the axes 13 but in the notional cutting plane, employing a bulb with an axial filament.

The optical system shown in FIG. 5 can be housed in the housing 34 shown in FIG. 6. The housing 34 comprises a body portion 34*a* and two end portions 34*b*,34*c*. The body portion 34*a* houses the reflector portions 22*a*,22*b* for generating two oppositely-directed light beams. The two beams generated in the body portion 34*a* are directed into respective end portions 34*b*,34*c* in which they are each incident on the plane mirrors 30*a*,30*b*. After being reflected from the mirrors, the beams leave the end portions 34*b*,34*c* through lenses 36 which perform the same function as the lens systems shown in FIG. 4. The housing 34 is mounted on a bracket 38 to be pivotable about an axis 40 which is substantially coincident with the central rays of the beams produced by the beam-generating apparatus. The bracket 38 is hung from a mounting bar 42 and is pivotable about an axis 44 which is perpendicular to the axis 40. A handle 46 is provided at each end of the housing 34 to enable the orientation of the housing to be altered. The portions 34a,34b,34c of the housing are connected by sleeves (not shown) through which the light beams pass from the reflector portions 22a,22b to the plane mirrors 30a,30b. The sleeves pass through holes in arms 38a of the bracket 38 to provide for the rotary mounting about the axis 40. For dental purposes, good results are obtained with the lamp unit of FIG. 5 with the filament and mirrors oriented as shown in that Figure, and incorporating the combined lens and prism of FIG. 9b, and the whole being housed in the housing of FIG. 6.

Preferably the bulb for the lamp unit of FIG. 5 is mounted on a plug-in mount which can be introduced into the housing from above, that is, with a motion generally perpendicular to the notional cutting plane. The reflector portions must be cut away sufficiently to accommodate the mount. The mount and the aperture into which it is introduced preferably have complementary and asymmetric outlines so that correct orientation and position of the bulb filament are ensured when the mount is fitted.

Alternatively, the bulb may be introduced along a line lying in the notional cutting plane, as in the arrangement of FIG. 5. In this arrangement, cutting away of parts of the reflector portions to accommodate the bulbs affects the light intensity at opposite ends of the two images (in the image plane), so that the intensity of the composite light patch is still symmetrical about the centre of the patch.

Current to the filament may be provided from two contacts on the surface of the mount, connected within the mount to the bulb filament. When the mount is correctly positioned in the housing, brushes in the housing connected to the power supply of the lamp unit feed current to the two contacts and so to the filament.

FIG. 7 shows an alternative embodiment of the invention which comprises two concave reflector portions 54. The reflector portions 54 are not sectorial portions but are each formed from a strip of reflective material. The strip reflectors 54 are curved so that they widen from respective beam-emission axes 13, which are shown to be in line in FIG. 7. The strip reflectors are opposed and overlap each other at their narrow ends 14 and widen to wide ends 18 at which ends are the beam-emitting apertures 16.

In all of the illustrated embodiments the beam-emission axes are in line but, as noted above they need only be generally oppositely directed. In the case of FIG. 3 for example, the reflector portions 22a and 22b may be tilted so that the axes 13 are inclined as shown by the broken line axes 13'. If apparatus with inclined axes is used in the lamp unit of FIG. 5, corresponding re-positioning of the mirrors 30a,30b and the lens systems 32a,32b will be necessary.

When the reflector portions are tilted in this way, the resultant beams are no longer identical. The beam from one reflector portion is partially blocked by the narrow end of the other reflector portion, while the beam from that other reflector portion is largely unaffected by the tilting.

Alternatively, one reflector portion may be rotated relative to the other about an axis perpendicular to the notional cutting plane. FIG. 10 shows two reflector portions positioned in this way. Preferably, in this arrangement the bulb is introduced along the rotational axis, through an opening in one of the reflector portions.

This arrangement could be used as the light source in a revolving warming beacon and coloured filters could be used so that the beacon appears to emit alternately beams of the two colours.

The reflector portions described above all have smooth reflective surfaces. Alternatively, they may have multi-faceted surfaces. That is, the surface may comprise a large number of smaller surfaces each of which acts as a small reflector. Discontinuities exist between adjacent small reflective surfaces, but the whole functions as a reflector which may be used in apparatus embodying the invention. Such multi-faceted surfaces are well-known in the art.

The light sources described above all have linear filaments. The shape of the filament may be varied within the scope of the invention, such variation causing a corresponding variation in the intensity distribution of the light in the light patch. For instance, bulbs with flattened coiled filaments, coiled coils or circular filaments may be used.

I claim:

1. A lamp unit for providing a patch of substantially shadow-free illumination at an image plane from a single light source, comprising two concave reflector portions each of which widens away from a respective beam-emission axis from a first end to a second end, at which second end is the beam-emitting aperture of the reflector portion, the two reflector portions confronting and overlapping each other at their first ends and having their beam-emission axes mutually divergent whereby a light source disposed between the overlapping regions of the reflector portions produces two mutually divergent beams, characterised in that each beam is convergent, and in that the lamp unit further comprises mirrors positioned to reflect respective ones of the beams to combine the beams at the image plane, lens systems arranged to focus the beams at the image plane, and a prism positioned in the path of one beam to redirect that beam so as to compensate for assymmetry between the beams and to bring the focused beams substantially into coincidence at the image plane.

2. A lamp unit according to claim 1, further characterised in that assymmetry between the beams is compensated for by two identical prisms positioned in the path of respective beams to redirect those beams, the prisms being inverted, one with respect to the other.

3. A lamp unit according to claim 1 or 2, characterised in that each lens system comprises a cylindrical lens.

4. A lamp unit according to claim 1, characterised by comprising at least one opaque stop member in the path of each beam, at least partially to delimit that beam.

5. A lamp unit according to claim 4, characterised by comprising a lens system in the path of each light beam, arranged to focus an image of the corresponding opaque stop member at the image plane.

6. A lamp unit according to claim 1, characterised in that the mirrors are so coated as to transmit or absorb light of infra-red wavelengths.

7. A lamp unit according to claim 1, characterised in that the concave reflector portions are sectorial portions of a concave reflector and have compound curvature.

8. A lamp unit according to claim 7, characterised in that each reflector portion is substantially a half of a concave reflector having a reflective surface which is a surface of revolution about the beam-emission axis.

9. A lamp unit according to claim 7, characterised in that each reflector portion is a physically or notionally cut-down half of a concave reflector having a reflective surface which is a surface of revolution about the beam-emission axis.

10. A lamp unit according to claim 1, in which the concave reflector portions are curved reflective strips.

11. A lamp unit according to claim 8 or 9, characterised in that the mirrors are perpendicular to the plane of the notional cut which bisects the concave reflector, and in which the lens systems comprise a prism oriented to transmit the central ray of the respective light beam in the said plane of the notional cut.

12. A lamp unit according to claim 11, characterised in that each lens system comprises a cylindrical lens, having a plane face facing the respective mirror, and in that in each lens system, the prism is integral with the cylindrical lens.

13. A lamp unit according to claim 1, characterised in that the reflector portions have respective foci which are coincident.

14. A lamp unit according to claim 1, characterised by a light source disposed between the overlapping regions of the reflector portions, which light source is a bulb with a filament.

15. A lamp unit according to claim 8 or 9, characterised in that the reflector portions have respective foci which are coincident, and the filament has a major dimension inclined with respect to the beam-emission axes and lying in a plane which is perpendicular to the plane of the notional cut bisecting the concave reflector, including the beam-emission axes.

* * * * *